United States Patent [19]

Bowker

[11] Patent Number: 4,529,205

[45] Date of Patent: Jul. 16, 1985

[54] WINERY GAME BOARD

[76] Inventor: Dennis E. Bowker, 1687 Sycamore St., Napa, Calif. 94558

[21] Appl. No.: 543,989

[22] Filed: Oct. 20, 1983

[51] Int. Cl.[3] ..... A63F 3/00

[52] U.S. Cl. ..... 273/256

[58] Field of Search ..... 273/256, 278

[56] References Cited

U.S. PATENT DOCUMENTS

| | | | |
|---|---|---|---|
| 2,178,330 | 10/1939 | Thomas | 273/254 |
| 3,148,885 | 9/1964 | Varlese et al. | 273/256 |
| 3,367,662 | 2/1968 | Charles et al. | 273/256 |
| 4,027,882 | 6/1977 | Rosenberg | 273/256 X |
| 4,397,467 | 8/1983 | Thornton | 273/256 |

FOREIGN PATENT DOCUMENTS

| | | | |
|---|---|---|---|
| 2001251 | 1/1979 | United Kingdom | 273/256 |
| 2021423 | 12/1979 | United Kingdom | 273/256 |

*Primary Examiner*—Richard C. Pinkham
*Assistant Examiner*—Scott L. Brown
*Attorney, Agent, or Firm*—Melvin R. Stidham

[57] ABSTRACT

A winery game board with an endless track of spaces, some where grapes may be purchased, some where wine may be bottled, and some where wine may be sold. Vineyard cards represent indicated amounts of acreage within each vineyard and there are tokens to represent various quantities of bottled wine. Each player has a winery card to show grapes in storage and wine in storage.

3 Claims, 5 Drawing Figures

WINERY GAME BOARD

BACKGROUND OF THE INVENTION

Many game boards have been developed in which the object of the game is to earn money through the accumulation of business assets. Some such games deal with the concept of commodities, which are purchased at some price and then held for speculation, in the hope that they will command a higher price when sold.

No game is known to simulate the situations common in many businesses, wherein raw materials are purchased at one stage, converted to a finished product at another, and sold in the marketplace at yet another. More particularly, there is no game which is know to be reflective of the wine industry, wherein wineries grow or purchase grapes, bottle the wine made from those grapes, and sell the finished product in various markets.

OBJECTS OF THE INVENTION

It is an object of this invention to provide a game board that simulates the business situation of the purchase of raw materials, conversion of those raw materials to goods, and sale of those goods in the marketplace.

It is a further object of this invention to provide a game board that simulates some of the business aspects of the wine industry.

Other objects and advantages of this invention will become apparent from the description to follow, particularly when read in conjunction with the accompanying drawings.

SUMMARY OF THE INVENTION

The invention includes a game board with a series of spaces forming a continuous path. Each player represents a winery, and moves a playing piece around the game board according to the throw of dice. The game board includes spaces where grapes may be purchased, spaces where purchased grapes may be converted to wine, and further spaces where the wine may be sold for a profit. The game is played until a set number of the wine "markets" are filled to capacity, and the plaer having the greatest net worth at that time wins the game.

DETAILED DESCRIPTION OF A PREFERRED EMBODIMENT

Figure 1:
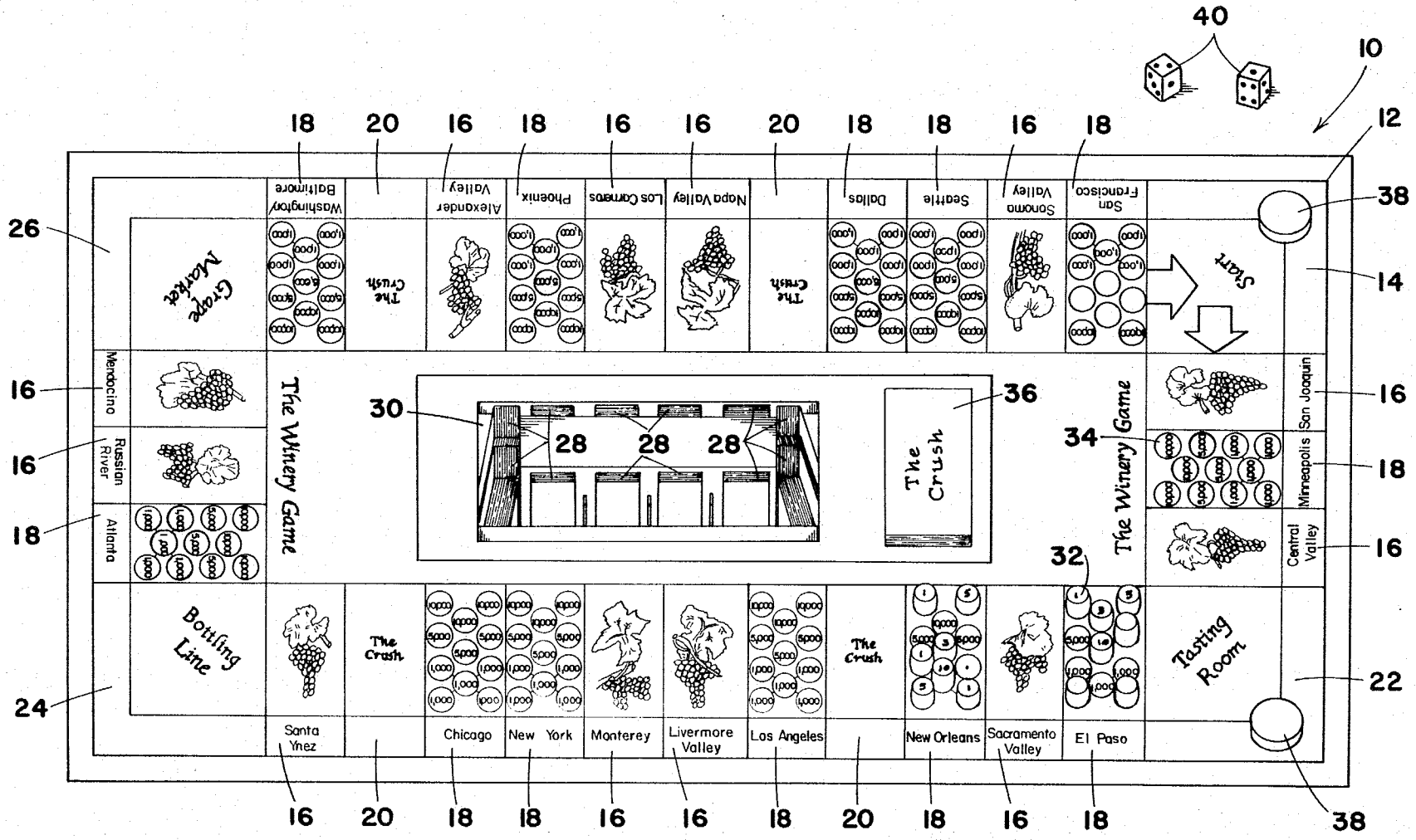
FIG. 1 is a perspective view of the game board, card rack with vineyard cards, bottled wine tokens, crush cards, playing pieces and dice used in the winery game board.

Referring now to FIG. 1 with greater particularity, the game board 10 of this invention has delineated thereon a peripheral track 12 comprising a plurality of spaces 14 through 26, forming a continuous path from a corner starting space 14 around the board. In the embodiment shown, the path includes thirty-two spaces: one "start" space 14, twelve "vineyard" spaces 16, twelve "market" spaces 18, four "crush" spaces 20, one "tasting room" space 22, one "bottling line" space 24 and one "grape market" space 26.

Each vineyard space 16 on the game board represents a two hundred acre parcel of grape producing land, which is in turn represented by twenty vineyard cards 28, each the equivalent of ten acres from that particular vineyard. These vineyards, as in the real world, may have different production levels, varying from, say, a low of two thousand cases of wine per ten acres, to a high of five thousand cases of wine per ten acres.

Placed in the center of the board 10 is a vineyard card rack 30, designed to hold vineyard cards 28, and display them in the same order in which the vineyards they represent appear on the path 14-26 track of the game board 10.

Bottled wine tokens 32 are used to represent grapes that have been bottled into wine. The wine tokens 32 may be marked, numbered, colored or otherwise differentiate to indicate varying amounts of bottled wine, say, one thousand to ten thousand cases. Market spaces 18 include areas 34 for the placement of bottled wine tokens 32, and these areas can likewise be marked to indicate a varying capacity, say, one thousand to ten thousand cases. The total storage capacity marked on each market space is fifty thousand cases.

Also placed in the center of the board is the stack of crush cards 36, which cards are drawn when a player lands on one of the four crush spaces 20.

Each player moves his own playing piece 38 around the board according to the throw of dice 40.

Figure 2:
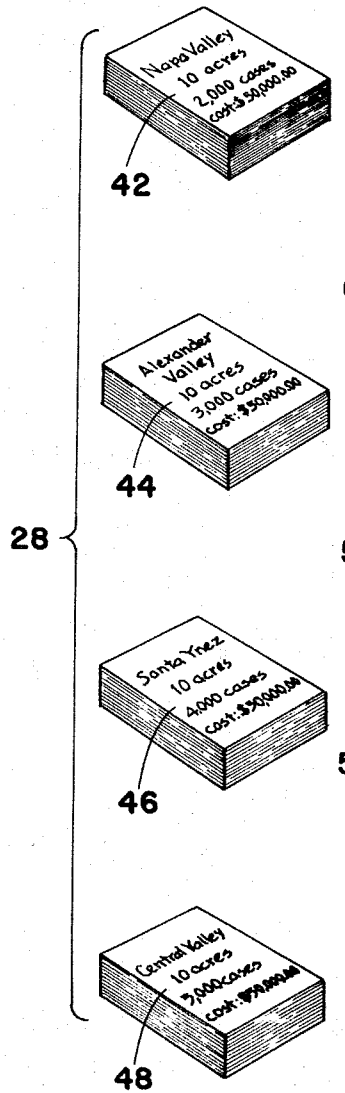
FIG. 2 is a perspective view of some of the vineyard cards.

As previously mentioned, the vineyards represented by the vineyard cards 28 (FIG. 2) may have different production levels. For example, the Napa Valley vineyard cards 42 represent ten acres from that area capable of production of two thousand cases of wine each, Alexander Valley vineyard cards 44 represent production of three thousand cases each, Santa Ynez vineyard cards 46 represent production of four thousand cases each, and Central Valley vineyard cards 48 represent production of five thousand cases each.

Figure 3:
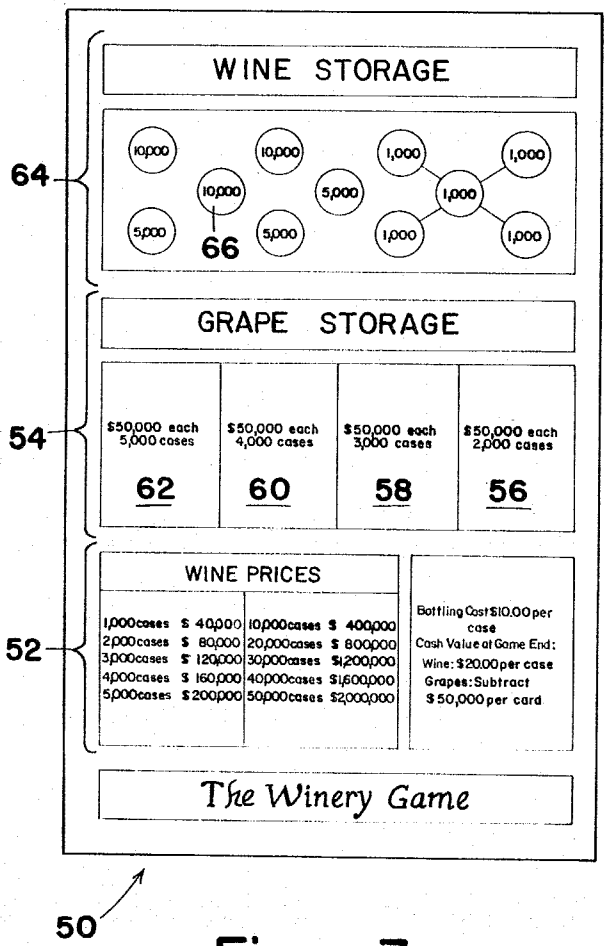
FIG. 3 is a top view of a winery card.

Each player receives one wine card 50 (FIG. 3), and uses it to organize and display his winery status. In addition to printed financial data 52, used to facilitate market transactions, each card contains a grape storage section 54, upon which vineyard cards 28 (FIG. 2) are placed, according to their production values. For example, grape storage unit 56 is used to place those vineyard cards that represent a two thousand case per ten acre production level such as Napa Valley vineyard cards 42, grape storage unit 58 is used for placement of three thousand case vineyard cards, such as Alexander Valley vineyard cards 44, grape storage unit 60 is used for placement of four thousand case vineyard cards, such as Santa Ynez vineyard cards 46, and grape storage unit 62 is used for placement of five thousand case vineyard cards, such as Central Valley vineyard cards 48.

The winery card 46 also contains a wine storage section 64, subdivided into areas 66 marked with inidica corresponding to different storage capacities for bottled wine. Analogous to the areas 34 on market spaces 18 (FIG. 1), previously described, these areas 66 are marked to indicate differing capacities of, say, one thousand to ten thousand cases. As with the market spaces, the total storage capacity marked in this wine storage section is fifty thousand cases.

Figure 5:
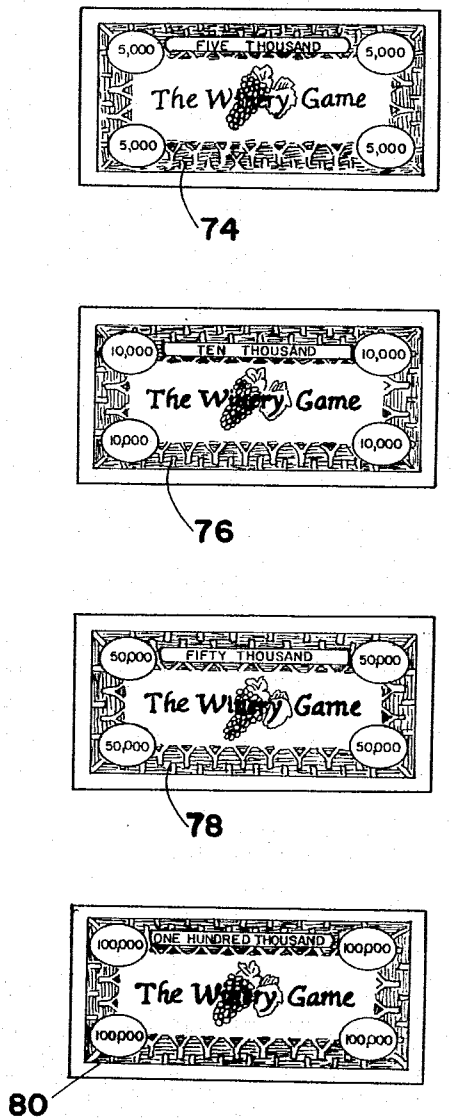
FIG. 5 is a front view of the game money used.
Figure 4:
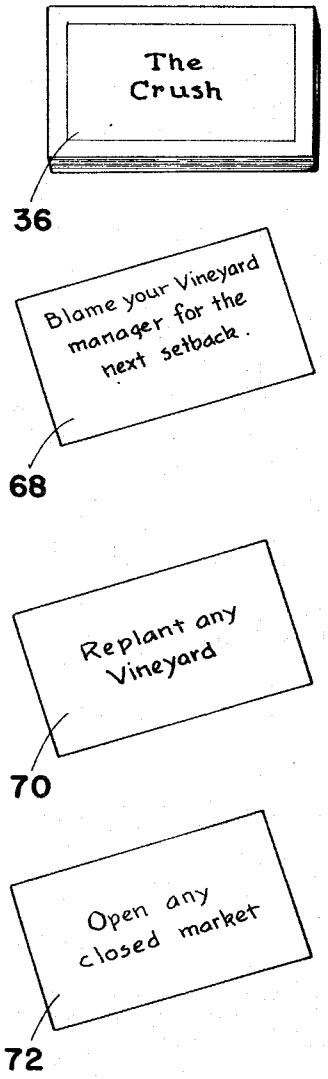
FIG. 4 is a perspective view of some of the crush cards.

Referring now to FIG. 4, there is shown a stack of crush cards 36, and a sampling of individual cards 68, 70 and 72, showing the information contained on the reverse side of some of the crush cards. In FIG. 5, there is shown a sampling of the various denominations of the game money used; a five-thousand dollar bill 74, ten-thousand dollar bill 76, fifty-thousand dollar bill 78, and one-hundred-thousand dollar bill 80.

PLAYING THE GAME

The Winery Game Board is designed to be played by two to six players, each representing a different winery. The object is to generate the most profits before eight of the twelve wine markets are filled to capacity. This is done by buying grapes represented by the vineyard cards 28, from the vineyard represented by vineyard spaces 16; bottling them into wine cases represented by the bottled wine tokens 32; and selling the wine at a profit to the markets represented by the market spaces 18.

Each winery starts with the following equipment: one winery card 50, one playing piece 38, 30,000 cases of stored wine, using two bottled wine tokens 32, which are marked or colored to indicate 10,000 cases, and two marked or colored to indicate 5,000 cases and $500,000.00 in cash.

Each player's winery is represented on the board 10 by his playing piece 38. Players begin at the start space 14, and move their pieces around the board according to the roll of the dice 40, following the directions for the space landed upon. Which winery moves first may be decided by a throw of the dice. Subsequent play should move clockwise. One player may be chosen to manage the bank, whose duties are described herein.

As previously described, there are twelve vineyards spaces 16 around the board, each representing an area of two hundred acres (twenty, ten acre vineyard cards 28). All vineyard cards, regardless of vineyard, cost $50,000.00 each, payable to the bank. When landing upon these vineyard spaces, a winery may, but is not required to, purchases these vineyard cards. In addition, landing on the grape market space 26 allows a winery to purchase any or all cards from any one vineyard having unsold acreage. After purchase, the vineyard cards are stored in the grape storage section of the winery card 50 until used. These is no limit to the number of grapes in storage.

During the course of the game, after grapes are purchased, they are bottled at a cost of ten dollars per case for all types of grapes, by exchanging the vineyard cards 28 to be bottled plus the ten dollars per case at the bank for the proper number of cases, i.e. bottled wine tokens 32. These tokens are then placed in the appropriate area 66 of the wine storage section 64 of winery card 50. A winery may bottle its wine when landing upon or passing the start space 14, when landing on the bottling line space 24, or drawing a crush card 36 that allows immediate bottling. Since no more than fifty thousand cases of bottled wine may be stored per winery card at any one time, wineries may bottle only that portion of their grapes that will fit in their storage area. Vineyard cards may not be split, for example, if there are three thousand cases of remaining capacity available in storage, only one two-thousand case vineyard card may be bottled, not one and a half.

Only bottled wines in storage when passing start may be sold in that turn. If a player passes start space 14 and lands on a market space 18 in the same turn, that player may not bottle wine and sell it immediately. Players may, however, sell bottled wine already in storage and use the proceeds to bottle and refill the storage area to capacity in the same turn. If a player lands on a vineyard space 16 when passing start, any grapes purchased then cannot be immediately bottled. They must ferment until the next bottling opportunity.

As previously described, there are twelve market spaces 18 on the board, each with a capacity of 50,000 cases of wine. All wine cases sell for $40.00 each in all markets. Any winery may sell wine in any market its playing piece lands upon, but no market may hold more than 50,000 cases. The money is paid to the winery by the bank when the cases (bottled wine tokens 32) are transferred from wine storage to market. Note: one 5,000 case marker may be placed in the center of the five 1,000 case circles to represent the filling of all five circles.

The sole purpose of the "tasting room" space 22 is to allow a player to replenish the wine supply in any empty glasses without interrupting play.

The crush cards 36 are so named because in the wine industry, harvest time (the crush) is when anything can happen. Upon landing on one of the crush spaces 20, the player must draw the top card and follow the instructions printed on it. Some are real benefits, some are definite setbacks, and some may be kept for later use.

Negotiations between the players should be encouraged. Grapes, wines, and some crush cards may all be bought, sold or traded amongst the players. In addition, wineries may lease their storage area (all or part) to other wineries in exchange for cash, wine, grapes or negotiable crush cards. The easiest method of doing so is to set a term of one or more passes around the board by one of the two wineries involved. If lease terms are not met and no other arrangements are made, the owner of the wine must sell the wine to the bank for twenty dollars per case.

When the eighth of the twelve markets is filled to capacity, the game ends. Each player then determines the net worth of his winery by converting all assets and liabilities to cash as follows: receive $20.00 from the bank for each unsold case, and pay fifty thousand dollars to the bank for each stored vineyard card not bottled. The player having the highest net worth wins the game.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A winery board game comprising:

a game board;

a track on said game board formed by a continuous series of spaces along which a game piece is movable in increments as determined by chance indicator means;

chance indicator means;

a plurality of said track spaces representing vineyards where grapes may be purchased;

a plurality of grape tokens for each of said vineyards, each grape token representing grapes harvested from a portion of said vineyard;

landing a game piece on a vineyard space entitling a player to purchase at least one grape token representative of said vineyard;

a winery warehouse card for each player;

each winery warehouse card including a grape storage area wherein grape tokens purchased by a player are stored;

at least one of said track spaces representing a bottling line where wine may be bottled;

a plurality of wine tokens;

each of said wine tokens beign marked to indicate a quantity of bottled wine;

landing a game piece on a bottling line space entitling a player to exchange grape tokens in said grape storage area plus a predetermined amount of cash for wine tokens;

each winery warehouse card including a wine storage area wherein wine tokens purchased by a player are stored;

at least one of said track spaces representing a market where bottled wine represented by wine tokens in said wine storage area may be sold; and areas marked on said market space for placement of said wine tokens according to the quantity of bottled wine they represent, as indicated thereon.

2. The winery bard game described in claim 1 wherein said grape tokens are cards, and including:

a card rack including a plurality of holding areas, each conditioned to hold a plurality of grape token cards representing a single vineyard so that said grape token cards may be displayed in the same order in which the vineyards they represent appear on said track of said game board.

3. The winery board game described in claim 2 wherein each of said grape token cards are marked to indicate different grape production levels for the different vineyards they represent.

* * * * *